US006488594B1

(12) United States Patent
Card et al.

(10) Patent No.: US 6,488,594 B1
(45) Date of Patent: Dec. 3, 2002

(54) PUTTER WITH A CONSISTENT PUTTING FACE

(76) Inventors: Richard C. Card, 6319 Northport Dr., Dallas, TX (US) 75230; Mark C. Myrhum, 4329 E. Melinda La., Phoenix, AZ (US) 85050-8802

( * ) Notice: Subject to any disclaimer, the term of this patent is extended or adjusted under 35 U.S.C. 154(b) by 0 days.

(21) Appl. No.: 09/574,177

(22) Filed: May 18, 2000

(51) Int. Cl.[7] ..... A63B 53/04; A63B 53/06; A63B 53/08

(52) U.S. Cl. ..... 473/340; 473/329; 473/342

(58) Field of Search ..... 473/329, 340, 473/342, 341, 336, 338, 332

(56) References Cited

U.S. PATENT DOCUMENTS

| | | | | | |
|---|---|---|---|---|---|
| 5,458,332 | A | | 10/1995 | Fisher | |
| 5,489,097 | A | * | 2/1996 | Simmons | 273/170 |
| 5,529,543 | A | * | 6/1996 | Beaumont, Sr. | 473/290 |
| 5,674,132 | A | | 10/1997 | Fisher | |
| 5,697,855 | A | * | 12/1997 | Aizawa | 473/350 |
| 5,716,290 | A | * | 2/1998 | Baker et al. | 473/313 |
| 5,746,664 | A | * | 5/1998 | Reynolds, Jr. | 473/252 |
| 5,807,188 | A | * | 9/1998 | Serrano et al. | 473/338 |
| 5,807,190 | A | * | 9/1998 | Krumme et al. | 473/342 |
| 5,921,871 | A | * | 7/1999 | Fisher | 473/329 |
| 6,024,652 | A | * | 2/2000 | Westbrook | 473/313 |
| 6,227,986 | B1 | | 5/2001 | Fisher | |
| 6,302,807 | B1 | * | 10/2001 | Rohrer | 473/329 |

OTHER PUBLICATIONS

Photocopy of front face of Burr Key prior art putter.
Photocopy of rear face of Burr Key prior art putter.

* cited by examiner

*Primary Examiner*—Raleigh W. Chiu
*Assistant Examiner*—Sneh Varma
(74) *Attorney, Agent, or Firm*—Lewis T. Steadman

(57) ABSTRACT

A club head for a golf putter includes a bottom surface, a toe, a heel opposite the toe and a ball striking side on one side of the club head. The ball striking side extends between the toe and the heel and has a center disposed between the heel and the toe. A face insert is carried by a portion of the club head and defines at least part of a ball striking surface on the ball striking side of the club head. The face insert is adapted to absorb energy near the center of the ball striking side so as to produce a coefficient of restitution that is substantially similar and consistent over a majority of the ball striking surface. The face insert deadens the ball striking side at or near the center of the club head so that the distance of putts, whether struck near the center or whether mis-hit and struck closer to the heel or toe, are substantially the same.

4 Claims, 2 Drawing Sheets

C
36
58
60
62
64
66
52
36
56
50
58
54

14
12
10
16
20
18

32
26
22
34
44
42
24
36

16
20
18
26
30
28
24
40
16
26
32
26
20
26
70
74
38
72
38
30
34
36

PUTTER WITH A CONSISTENT PUTTING FACE

BACKGROUND OF THE INVENTION

1. Field of the Invention

The present invention relates generally to golf clubs, and more particularly to a golf putter that produces a highly consistent putting distance regardless of where on the putter face that the ball is struck.

2. Description of the Related Art

Most golf clubs including putters produce the most accurate and longest distance shot when the ball is struck on what is known as the "sweet spot". The sweet spot of a putter is typically located at or near the geometric center of the club face. Attempts have been made with all golf clubs to increase the size of the sweet spot so that mis-hits, such as when balls are struck on a portion of the club face that is not the sweet spot, will still produce a shot having relatively the same distance as when the ball is struck directly on the sweet spot.

Club manufacturers have devised numerous ways to increase the performance of golf clubs so that a ball travels travel further when mis-hit. Nearly all of these attempts involve trying to increase the size of the sweet spot to reduce the effects of a mis-hit. However, the putting stroke requires a club head speed that is only a fraction of the speed required for virtually all other golf shots. The result is that most club head design improvements do not significantly improve putter performance. In addition, such club head designs often require expensive materials, result in more complicated dies and molds for making the club heads, and are highly design intensive, thus resulting in a more expensive putting product.

Mis-hits are a major cause of putting problems both for highly skilled and modestly skilled golfers. The more skilled golfer can notice any change in distance resulting from even the slightest mis-hit. Less skilled golfers may be less sensitive to distance changes when slightly mis-hitting the ball, but are much more likely to mis-hit the ball more often and by larger margins. In either case, both the highly skilled and modestly skilled golfer putt inconsistently.

One example of a commonly used putter that is designed to increase the size of the sweet spot is manufactured by the Wilson® Sporting Goods Company and is identified as model no. 8813. This putter includes a putting head with a putting face with a thickness near the top edge that is consistent but relatively thin. The bottom of the putting head is much thicker and varies over the length of the putting face. More mass is provided near the toe and near the center to increase the size of the sweet spot. However, mis-hits still result in shorter putts when struck on the toe or heel of the ball striking surface.

Another method of increasing the mass of the putter near the toe is to provide one or more recesses and to place weighted elements in each of the recesses. The weighted elements are manufactured from a material having a higher density than the material of the putter head. In this manner, the mass of the toe can be increased in order to increase the torque applied to the putting head near the toe, away from the hosel, to increase the distance of putts struck nearer the toe.

SUMMARY OF THE INVENTION

One object of the present invention is to provide a putter that produces putts of substantially equal distance whether struck on the heel or toe of the putter face. Another object of the present invention is to provide a putter that has a putter face which produces putts of substantially equal distance whether struck on the toe, the heel, or at the center of the putting face. A further object of the present invention is to provide a putter that is designed to shorten the distance of putts struck at the center of the putting face to substantially match the distance of putts struck on the heel or toe of the putting face. A still further object of the present invention is to provide a putter having a putter face insert that deadens the sweet spot and is relatively light in weight, relatively simple to manufacture, and utilizes readily available materials to construct the insert.

These and other objects, features and advantages are provided by a putter constructed in accordance with the present invention. In one embodiment, a club head for a golf putter has a bottom surface, a toe, a heel opposite the toe, and a ball striking side that extends between the heel and the toe. The ball striking side has a center disposed between the heel and the toe. A face insert is carried by a portion of the club head and defines at least part of a ball striking surface on the ball striking side of the club head. The face insert is adapted to absorb energy near the center to produce a substantially consistent coefficient of restitution over a majority of the ball striking surface.

In one embodiment, the face insert of the club head is formed from a material that is softer than a material of the club head. In another embodiment, the face insert is formed from a Balata rubber material.

In one embodiment, the face insert of the club head includes a face section having a toe end, a heel end, a back surface facing the ball striking side, and a front surface opposite the back surface. The face insert also includes an energy absorbing section disposed near the center and extending from the back surface of the face section.

In one embodiment, the face section of the face insert has a generally oblong shape covering a portion of the ball striking side of the club head. The ball striking side of the club head and the front surface of the face section together define the entire ball striking surface. In another embodiment, the face section has a size and shape that matches a size and shape of the ball striking side of the club head so that the front surface of the face section defines the entire ball striking surface.

In one embodiment, the energy absorbing section is a generally circular cylinder having an axis substantially perpendicular to the front surface of the face insert.

In one embodiment, a toe thickness of the face section from the toe end to near the center is less than or equivalent to a heel thickness of the face section from near the center to the heel end. In another embodiment, the toe thickness and the heel thickness are constant from the toe end and from the heel end, respectively, to near the center. In an alternative embodiment, the toe thickness of the face section from the toe end to near the center and the heel thickness of the face section from near the center to the heel end each become gradually thicker over a portion of the face section approaching the center. In a further embodiment, the toe thickness is greater than or equivalent to the heel thickness.

In one embodiment, the club head also includes a recess in the ball striking side of the club head wherein the face insert is received in the recess.

In one embodiment, the club head also includes a bore near the center in the ball striking side of the club head wherein the energy absorbing section of the face insert is received in the bore. A shallow recessed section surrounds the bore in the ball striking side of the club head and at least a portion of the face section back surface contacts the shallow recessed section. The back surface of the face section portion is adhered to the ball striking side of the club head within the shallow recessed section. In another embodiment, the entire face section is received in the shallow recessed section and the front surface of the face section is co-planar with the ball striking side of the club head beyond a perimeter edge of the face section. In this embodiment, the front surface of the face section and the exposed portion of the ball striking side of the club head together define the entire ball striking surface. In an alternative embodiment, the front surface of the face section covers the ball striking side of the club head and defines the entire ball striking surface.

In one embodiment, the club head also includes at least one weight insert carried in a corresponding recess in the club head. The at least one weight insert is formed from a material that has a density greater than a density of a material forming the club head.

In another embodiment of the invention, a golf putter has a shaft with an upper end and a lower end. A grip is carried on the upper end of the shaft. A club head is carried on the lower end of the shaft and is formed from a club head material. The club head has a bottom surface, a toe, a heel opposite the toe, a ball striking side extending between the heel and the toe, and a center disposed between the heel and the toe. A face insert is carried by a portion of the club head and defines at least part of a ball striking surface on the ball striking side of the club head. The face insert is formed from a material that is softer than the club head material. In one embodiment, the face insert is formed from a Balata material.

In one embodiment, the face insert of the face section has a toe end, a heel end, a back surface facing the ball striking side, and a front surface opposite the back surface. An energy absorbing section is disposed near the center and extends from the back surface of the face section.

In one embodiment, a toe thickness of the face section from the toe end to near the center is less than a heel thickness of the face section from near the center to the heel end.

In another embodiment, the golf putter also includes a bore near the center in the ball striking side of the club head wherein the energy absorbing section of the face insert is received in the bore. A shallow recessed section surrounds the bore in the ball striking side of the club head. At least a portion of the face section back surface contacts the shallow recessed section. The back surface of the face section is adhered to the ball striking side of the club head.

These and other objects, features and advantages of the present invention will become apparent upon a reading of the entire specification including the drawing figures and claims. Although preferred embodiments of the present invention are disclosed and described herein, the following description is provided in order to illustrate aspects of the present invention and not in any way to limit the scope of the invention. Many modifications and changes can be made to the present invention as described herein without departing from the spirit and scope of the invention. The present invention is intended to include such changes and modifications.

DETAILED DESCRIPTION OF THE PREFERRED EMBODIMENTS

The present invention is generally directed to a putter head for a golf club used to putt a golf ball. The putter or club head of the invention functions in reverse of most modem putters. Recent putter designs attempt to utilize technology that increases the size of the sweet spot to reduce the effects of mis-hits or to increase the mass of the putter head heel and toe to match the sweet spot putt distances. In contrast, the present invention provides a putter head that decreases the distance of putts that are struck at the geometric center or sweet spot of the putter face. In doing so, putts struck at the center of the putter face travel substantially the same distance as putts struck on either the heel or toe of the putter face.

The term "coefficient of restitution" has a number of different meanings in scientific circles. In general, it is essentially a constant which is the ratio of the relative velocities of two elastic spheres after direct impact to the velocities before impact. In golf circles, the meaning of coefficient of restitution is very similar, though tailored to golf balls and golf clubs. The coefficient of restitution in golf also has several slightly different meanings. One example is that the coefficient of restitution is known as the ability of a golf ball to regain its roundness after impact. The quicker it regains its roundness the further it will fly and the slower it regains its roundness the shorter it will fly. Thus, a softer ball will generally travel less distance because it absorbs more of the impact energy. The more preferred meaning, as used herein, is that the coefficient of restitution is the relationship of club head speed at impact with a golf ball to the velocity of the ball after it has been struck. It is a measure that is affected both by the club face and by the ball material. Thus, the coefficient of restitution will determine the velocity and therefore the distance of a ball from a strike by a putter. The goal of the present invention is to produce a substantially consistent coefficient of restitution over the club face of a putter. The present invention does so by reducing the coefficient of restitution near the sweet spot or geometric center of the club face so as to match the coefficient of restitution near the heel and toe of the club face. This solution is generally opposite to conventional wisdom in golf technology.

Figures 1, 2, 3, 4, 5:
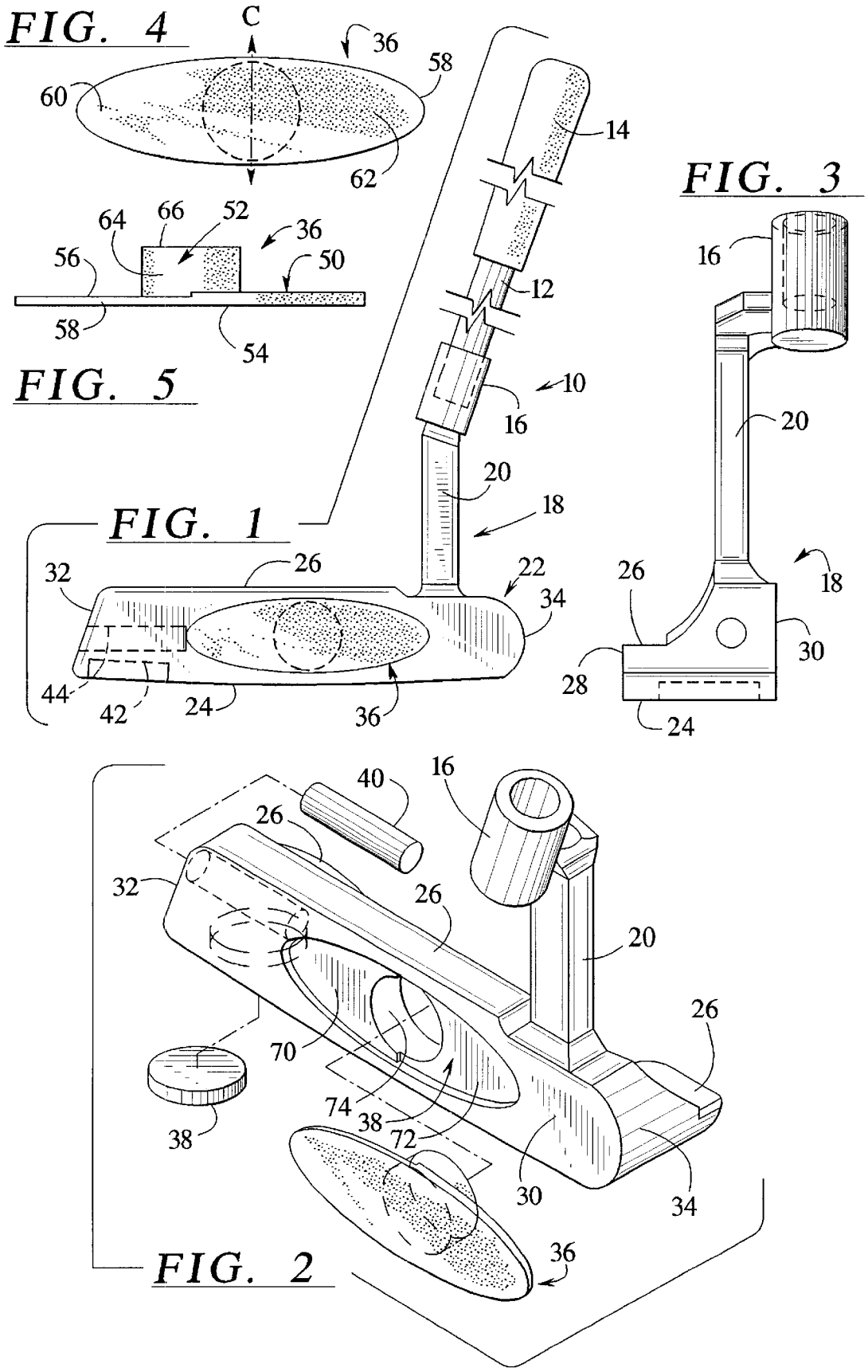
FIG. 1 illustrates a front view of a putter constructed in accordance with one embodiment of the present invention.
FIG. 2 illustrates an elevational perspective and exploded view of the putter head of the putter shown in FIG. 1.
FIG. 3 illustrates a toe end view of the putter head shown in FIG. 2.
FIG. 4 illustrates a front view of the putter face insert of the putter head of FIG. 2.
FIG. 5 illustrates a top view of the putter face insert shown in FIG. 4.

Referring now to the drawings, FIG. 1 illustrates a front view of a putter assembly 10 constructed in accordance with the present invention. The putter assembly 10 includes a putter shaft 12 that is shown in fragmentary form in FIG. 1. The putter shaft at an upper end includes a grip 14 secured thereon. The grip provides a comfortable gripping surface that also reduces slip of the club when it is held in a golfer's hand.

A lower end of the shaft 12 is received in a hosel 16 carried on a putter head assembly 18. The putter head 18 includes a neck 20 that extends upward from a putter body 22 and that carries the hosel 16 on its upper end. The putter body 22 includes a bottom surface 24, a multi-elevation top surface 26, a back surface 28 and a front ball striking surface 30. The putter head 18 also includes a toe end 32 and an opposite heel end 34. The heel end is disposed near the neck 20. The majority of the putter body 22 extends radially from the shaft 12 and neck 20 and terminates at the toe end 32. The putter head 18 also includes a face insert 36 received in a cavity 38 formed in the ball striking surface 30. One or more optional weighted inserts, such as the inserts 38 and 40, can be included on or added to the putter head 18 in order to further balance the heel and toe putting characteristics of the ball striking face 30.

The putter body in this embodiment is similar in construction to many modern putters. However, the present invention is capable of being used with virtually any shape, size and contour putter body. The present invention is even suitable for use with old fashioned symmetrical "blade style" putters.

The weighted insert 38 is received within a recess 42 in the bottom surface 24 of the putter body 22. The recess 42 is disposed in one embodiment near the toe end 32. The second exemplary weighted insert 40 is received directly in a cylindrical recess 44 in the toe end 32. The weighted insert 38 is in the form of a disk received in a correspondingly shaped cavity. The weighted insert 40 is in the form of cylinder received in a correspondingly shaped cavity. In the present embodiment, the weighted inserts 38 and 40 are provided to increase the mass of the putter body 22 near the toe 32. In many putters, the toe end provides the shortest distance putts. The weighted inserts will increase the mass to slightly increase the distance of putts struck near the toe of the ball striking surface 30 in order to match or nearly match the distance of putts struck near the heel. As will be evident to those skilled in the art, the positioning of the weights and the number of weights can vary as needed for a particular putter design. The weights are intended to somewhat balance the face so that putts from the toe and the heel travel about the same distance for an equivalent putting stroke. Some putters produce the shortest putts when struck on the heel. The weights can be added to the heel of such a putter.

The face insert 36 in one embodiment is molded as an integral unitary structure that has a ball striking section or face section 50 and an energy absorbing section 52. The ball striking section 50 as illustrated in FIGS. 4 and 5 is oval or elliptical in shape wherein the height is less than the width of the ball striking section. The ball striking section 50 includes a front surface 54 and a back surface 56 opposite the front surface. The ball striking section 50 also includes a perimeter edge 58 that defines the outer perimeter of the section. The ball striking section 50 further includes a toe end 60 that, when installed in the recess 38 of the putter head body 22, is disposed near the toe 32 of the putter body 22. The ball striking section 50 also includes a heel end 62 that is disposed near the heel 34 of the putter body 22 when installed.

Figure 6:
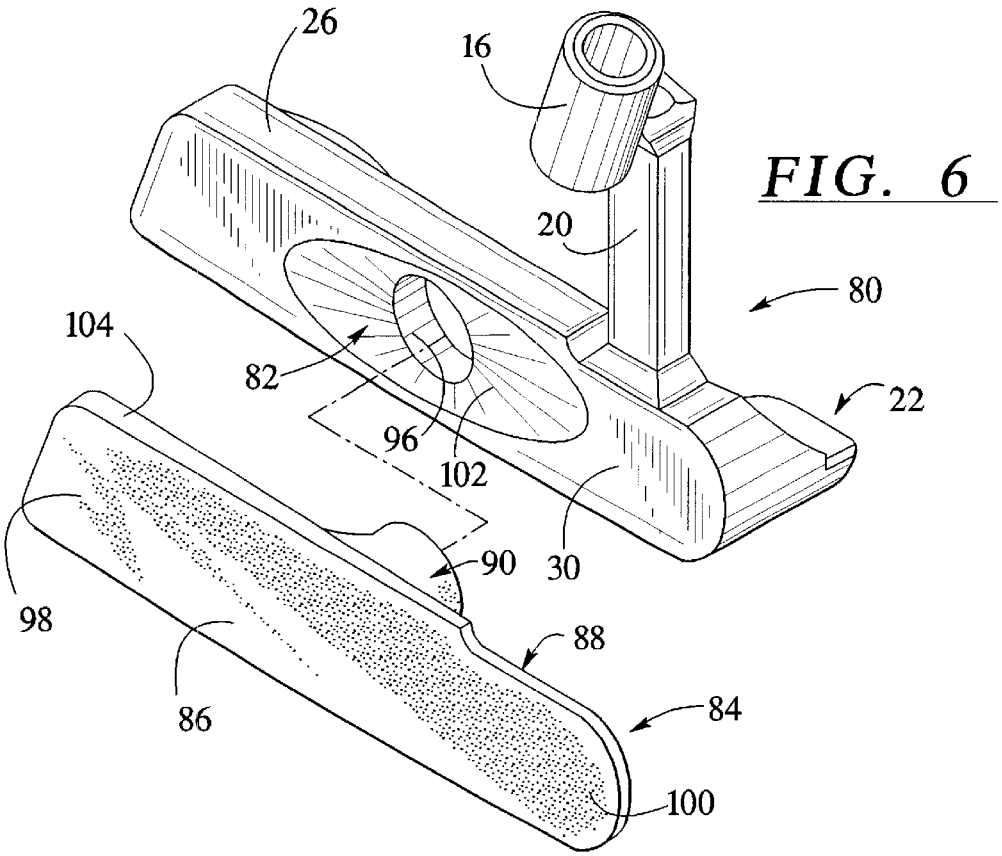
FIG. 6 illustrates an alternative embodiment of a putter head constructed in accordance with the present invention.

As best illustrated in FIGS. 2 and 4, the thickness of the ball striking section 50 of the face insert 36 is different in comparing the toe end 60 and heel end 62. The thickness of the ball striking or section 50 at the toe end is thinner than the thickness of the face section at the heel end 62. This is because the least energy absorption is typically required near the toe 32 of the putter head assembly 18 as is described below in more detail. The thickness of the heel end 62 is slightly greater than that of the toe end. The heel 34 of the putter head 18 requires a slightly increased energy absorption characteristic than the toe in order to produce putts of generally equal distance, regardless of whether the putt is struck on the heel or toe of the putter head 18. Instead of having different thicknesses, some putters may require that the entire ball striking section 50 be of the same thickness. Other putters may require that the toe end be thicker than the heel end (as shown in FIG. 6). The invention is intended to embody these alternative constructions as well.

The energy absorbing section 52 extends from the back surface 56 of the ball striking section 50. The energy absorbing section 52, as is illustrated in FIG. 5, is much deeper or thicker than the ball striking section 50. The energy absorbing section 52 also includes a perimeter edge 64 and a terminal end 66. The shape or contour of the perimeter edge 64 can vary considerably and yet fall within the scope of the present invention. It is desired however that the energy absorbing section 52 be smaller than the ball striking section 50 in order to effectively accomplish the objects of the present invention. Therefore, the energy absorbing section 52, including its perimeter edge 64, is generally within the boundary of the perimeter edge 58 of the ball striking section 50. In the present embodiment, the energy absorbing section 52 is in the form of a circular cylinder. Other shapes, contours and thicknesses are certainly also possible. The distance between the back surface 56 of the ball striking section 50 and the terminal end 66 of the energy absorbing section 52 defines the thickness of the absorbing section. This thickness at the center is again substantially greater than the thickness of either the toe end 60 or the heel end 62 of the ball striking section 50.

The recess 38 in the putter body 22 corresponds in shape and contour to the shape and contour of the face insert 36. When installed, as is illustrated in FIGS. 1 and 3, the front surface 54 of the face insert 36 is flush or co-planar with the ball striking or front surface 30 of the putter assembly 18. The recess 38 includes a recessed toe section 70 and a recessed heel section 72 that correspond in depth to the thickness of the toe end 60 and heel end 62 of the ball striking section 50 of the face insert 36. A cylindrical bore 74 is formed generally at or near the geometric center of the putter body 22 and through the putter body generally perpendicular to the ball striking side 30. The cylindrical bore 74 is intended to correspond to the depth or thickness and to the perimeter edge 64 so that the energy absorbing section 52 fits in the bore and so that the back surface 56 of the ball striking section 50 rests against the appropriate surfaces of the recess sections 70 and 72.

In order to secure the face insert 36 in place, an adhesive can be utilized on all surfaces between the ball striking section 50 and of the recess 38 that contact one another. The adhesive can either be applied to the appropriate back surfaces of the ball striking section, the appropriate surfaces of the recess 38, or to both. It is preferred that the dimensional tolerances of the perimeter edge 58 of the ball striking section and the perimeter edge 64 of the energy absorbing section closely correspond to the respective dimensions of the recess 38 so that there is little play between the insert and the putter body. However, it is preferred, but not absolutely necessary, that no adhesive be applied between the energy absorbing section 52 and the bore 74. The energy absorbing section is therefore able to move relative to the putter body and absorb energy more effectively.

Figure 7:
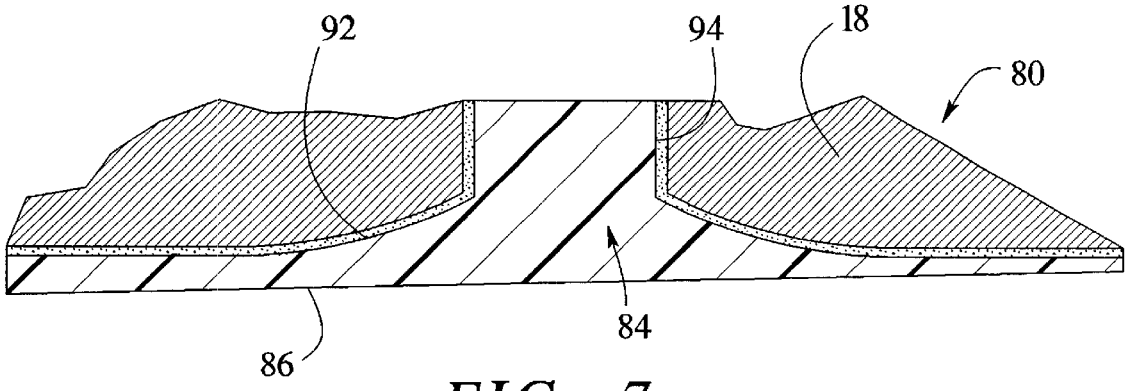
FIG. 7 illustrates a fragmentary sectional view taken along the line VII—VII of the putter head shown in FIG. 6.

As will be apparent to those skilled in the art, the particular shape, contour and size of the face insert 36 as well as the recess 38 can vary considerably and yet fall within the scope of the present invention. A second exemplary embodiment is illustrated in FIGS. 6 and 7. In this embodiment, a putter head assembly 80 includes a different alternative construction of a recess 82 and face insert 84. Generally, in contrast to the prior embodiment, a front surface 86 of the face insert 84 defines the entire ball striking surface. The front side 30 of the putter body 22 is intended to be completely covered by the face insert 86. In this embodiment, the ball striking surface 86 is completely formed of the same material and formed by the face insert 84.

The face insert 84 as illustrated in FIGS. 6 and 7 includes a ball striking section 88 and an energy absorbing section 90 that extends from a back surface 92 of the ball striking section 88. The energy absorbing section 90 again includes a perimeter edge or surface 94 received in a corresponding bore 96 of the recess 82. In this embodiment, the back surface 92 of the ball striking or face section 88 gradually tapers or gradually increases in thickness over part of the face section from the toe end 98 toward the energy absorbing section and from the heel end 100 toward the energy absorbing section 90. The recess 82 includes a corresponding tapered section 102 that mates with the tapered portion of the back surface 92 of the insert. Therefore, in this embodiment, the thickness dimension of the ball striking section varies over at least part of its surface and provides a more gradual change in the energy absorbing characteristics of the insert. The gradual change in thickness of the face insert can be designed to provide gradual changes in the coefficient of restitution of the putter head assembly 80 to compensate for the gradual changes in putting characteristics from the geometric center of the putter head assembly toward the heel and toward the toe. The construction illustrated in FIGS. 6 and 7, tailored to a particular putter body design, can therefore provide an even more consistent ball striking surface or coefficient restitution for the putter head assembly. In addition, the toe end 98 is illustrated as being thicker than the heel end 100, also in contrast to the prior embodiment.

The ball striking section 88 of the face insert 84 includes a perimeter edge 104 that corresponds to the shape of the front side 30 of the putter body 22. The ball striking or face section 88 therefore covers the entire front side 30 defining the entire ball striking face of the putter. In some rules or regulations, a putter may be required to have a putting face that is made of entirely the same material. As will be evident to those skilled in the art, in the previously described embodiment, the ball striking section 50 could also be extended with a thin skin to cover the entire front side 30 of the putter body 22.

The face insert of the present invention as exemplified in the embodiments described above is intended to deaden the geometric center of the putter head assembly. In doing so, putts struck on the sweet spot near the geometric center will travel a slightly less distance than if no face insert where incorporated. The object is to reduce the distance of putts struck at the geometric center or the sweet spot so that a putt struck anywhere on the ball striking surface of the putter head will travel essentially the same distance. Instead of trying to increase the size of the sweet spot, as has been done in the prior art, the effectiveness or coefficient of restitution of the putter at the sweet spot is deadened or reduced to match that of either the toe, the heel, or both.

Therefore, the materials selected for the insert of the invention must be softer than the material of the putter body 22. A typical putter body is made from a metal or hard composite such as aluminum, brass, steel, a combined alloy, graphite or the like. In order to absorb more energy, the material selected for the face insert should be softer than the metallic material of the body. Any number of materials will be suitable for the face insert, depending upon the putting characteristics desired for a particular putter assembly 10. The insert material can be selected from rubber elastomer, plastic, composite materials, or the like. One example of the present invention that was constructed and tested incorporated a putter body 22 constructed of 304SS, a cast stainless steel, including weighted inserts 38 and 40 made from tungsten. The face insert was made from a natural rubber material known as Balata which is used to make many golf ball covers. The face insert used during one test was similar to the insert 36 in FIGS. 4 and 5. The thick energy absorbing section 52, when made from the relatively soft insert material, absorbs energy upon contact with a golf ball and thus reduces the distance traveled by the golf ball. The thinner sections of the face insert near the toe and heel of the putter head assembly absorb much less energy and therefore do not significantly reduce the distance of ball travel. The face insert has no effect on putts struck on the surface 30 of the body 22 beyond the edge 58 of the insert. The thickness of the ball striking section 50 of the face insert near the heel and toe ends could be varied to further fine tune the coefficient of restitution produced by those portions of the insert. Similarly, the width of the ball striking section of the insert could also be increased or decreased to further alter the putting characteristics of the putter head assembly. Also, the thickness, diameter and width of the energy absorbing section can also be varied in order to further fine tune the deadening characteristics near the center of the putter head assembly.

In the exemplary sample of the invention constructed for testing, the thickness of the toe end 60 of the insert was about 1 mm (one millimeter) and the thickness of the heel end of the ball striking section was about 2 mm. The height of the ball striking section was about 19 mm and the width of the ball striking section was about 61 mm. The depth or thickness of the energy absorbing section was about 7.6 mm and the diameter of the energy absorbing section was about 17 mm. The weighted tungsten insert 38 was 28 grams and the weighted tungsten insert 40 was 13.7 grams and the entire weight of the assembled putter head assembly was about 330 grams.

A mechanical putting machine used to test putter performance and golf ball performance was utilized to test the prototype putter construction of the present invention described above. The prototype was compared to a standard Wilson Staff model no. 8813 putter. Each test was conducted by first preforming a center strike on a ball, a toe strike on the ball and a heel strike on the ball without moving the machine. Therefore three separate ball travel paths were followed by the tested putts depending upon where the ball was struck on the club face. Each test was also conducted utilizing a Titleist® DT90 wound golf ball. A total of twelve test cycles including three putts for each cycle was conducted for both the sample comparison club and the prototype club. The sample comparison test data is disclosed below in Table I and the prototype club test data is provide below in Table II.

The tests were performed on an artificial putting surface Grapevine Golf Research Center. The surface was rolled prior to testing each putter.

TABLE 1

Grapevine Golf Research Facility Mechanical Putter Data

| | | | | | | |
|---|---|---|---|---|---|---|
| DATE | | | 3/10/00 | | | |
| START | | | 4:07 PM | | | |
| FINISH | | | 4:29 PM | | | |
| FIELD CONDITIONS | | | Good | | | |
| CLUB | | | W/S 8813 | | | |
| BALL | | | Titleist DT 90 Wound | | | |
| | CENTER | | TOE ¾" | | HEEL ¾" | |
| | Distance | Dispersion | Distance | Dispersion | Distance | Dispersion |
| Avg | 281.46 | 0.00 | 249.19 | 0.00 | 250.79 | 0.00 |
| Std Dev | 6.11 | 0.00 | 8.38 | 0.00 | 5.60 | 0.00 |
| Abs Avg | | 0.00 | | 0.00 | | 0.00 |
| 1 | 286 | | 252 | | 247.75 | |
| 2 | 283 | | 251 | | 244 | |
| 3 | 276.25 | | 233 | | 248.5 | |
| 4 | 276.25 | | 245.75 | | 248 | |
| 5 | 288 | | 257 | | 258.75 | |
| 6 | 285.25 | | 252 | | 242.5 | |
| 7 | 278.25 | | 256.5 | | 252.5 | |
| 8 | 270.25 | | 246.75 | | 246.25 | |
| 9 | 289 | | 254.25 | | 260.75 | |
| 10 | 273 | | 242.25 | | 251.5 | |
| 11 | 284.5 | | 249.25 | | 258 | |
| 12 | 287.75 | | 250.5 | | 251 | |

TABLE II

Grapevine Golf Research Facility Mechanical Putter Data

| | | | | | | |
|---|---|---|---|---|---|---|
| DATE | | | 2/25/00 | | | |
| START | | | | | | |
| FINISH | | | | | | |
| FIELD CONDITIONS | | | Good | | | |
| CLUB | | | DC Prototype #2 | | | |
| BALL | | | Titleist DT 90 Wound | | | |
| | CENTER | | TOE ¾" | | HEEL ¾" | |
| | Distance | Dispersion | Distance | Dispersion | Distance | Dispersion |
| Avg | 297.69 | 0.00 | 289.88 | 0.00 | 289.25 | 0.00 |
| Std Dev | 7.06 | 0.00 | 3.79 | 0.00 | 5.35 | 0.00 |
| Abs Avg | | 0.00 | | 0.00 | | 0.00 |
| 1 | 304.5 | | 298 | | 294 | |
| 2 | 288.25 | | 288.25 | | 293.5 | |
| 3 | 294.5 | | 288.25 | | 287 | |
| 4 | 299.75 | | 288.5 | | 296.75 | |
| 5 | 312.25 | | 297.5 | | 290 | |
| 6 | 298.5 | | 290.75 | | 291 | |
| 7 | 299.5 | | 288.5 | | 282.5 | |
| 8 | 296.75 | | 286.25 | | 282.75 | |
| 9 | 288 | | 287.5 | | 297.5 | |
| 10 | 292 | | 291 | | 290.25 | |
| 11 | 306.25 | | 286 | | 282.75 | |
| 12 | 292 | | 288 | | 283 | |

The mechanical putter works as a gravity or pendulum type putter wherein the putter swings freely by gravity and is supported at a pivot. No force is applied by the machine. Instead, each putt is performed by raising the putter to the same height or arc and then releasing the putter. The only difference between the two tests was that the standard or center hit putting distance was slightly different for the two putters. The standard test swing for the Wilson Staff sample comparison putter produced an average center hit putt of about 23.5 ft. The average distance for a standard test swing center hit putt utilizing the prototype putter was about 24.75 ft.

The Wilson Staff model no. 8813 putter has a construction that attempts to increase the size of the sweet spot as discussed above. For the sample comparison test, the average center hit putt over 12 putts was about 23.45 ft. as can be seen in Table I. Utilizing the same mechanical putter swing, putts struck 0.75 in. from the center toward the toe produced an average putt distance of about 20.77 ft. A significant reduction in putting distance results when utilizing the sample comparison club and when mis-hitting a golf ball by 0.75 in. from the center. This reduction translates to an 11.47% drop in putting distance. Similarly, the average distance for putts struck 0.75 in. off center toward the heel of the comparison putter traveled an average distance of about 20.90 ft. This translates to a 10.9% drop when putting 0.75 in. off center toward the heel of the sample putter.

In stark contrast, the prototype putter of the invention produced much more consistent results. As can be seen in Table II, the prototype putter produced an average center hit putt distance of 24.81 ft. Utilizing the same mechanical putter swing as the center putts for the prototype club, an average distance of about 24.16 ft was produced when a ball was struck 0.075 in. from center toward the toe. An average of about 24.10 ft. was produced when putts were struck 0.075 in. off center toward the heel of the prototype club. Therefore, only a seven or eight inch difference occurred utilizing the prototype putter. Only a 2.6% distance loss on average occurred when a 0.75 in. mis-hit toward the toe occurs utilizing the prototype club. Similarly, only a 2.8% loss of distance occurs when a ball is mis-hit 0.75 in. off center toward the heel of the prototype club. As can be seen in comparing the data, a significant improvement in the coefficient of restitution efficiency or consistency is achieved when utilizing the putter construction of the present invention.

Changes and modifications can be made to the embodiments disclosed herein. The disclosed embodiments are provided only to illustrate the present invention and not in any way to limit the scope of the invention. The invention is intended to be limited only by the scope of the appended claims.

What is claimed is:

1. A club head for a golf putter, the club head comprising:

a bottom surface;

a toe;

a heel opposite the toe;

a ball striking side extending between the heel and the toe and having a center disposed between the heel and the toe; and a unitary face insert carried by a portion of the club head and defining at least part of a ball striking surface on the ball striking side of the club head, the face insert being a softer material than the club head and varying in energy absorption over its ball-striking surface to thereby absorb more energy near the center to produce a substantially consistent coefficient of restitution over a majority of the ball striking surface, wherein the face insert further comprises:

a face section having a toe end, a heel end, a back surface facing the ball striking side, and a front surface opposite the back surface;

an energy absorbing section disposed near the center and extending from the back surface of the face section; and wherein a toe thickness of the face section from the toe end to near the center and a heel thickness of the face section from near the center to the heel end each become gradually thicker approaching the center.

2. The club head according to claim 1, wherein a toe thickness of the face section from the toe end to near the center is greater than or equivalent to a heel thickness of the face section from near the center to the heel end.

3. The club head according to claim 1, wherein the face section has a size and shape that matches a size and shape of the ball striking side of the club head so that the front surface of the face section defines the entire ball striking surface.

4. The club head according to claim 1, further comprising:

a bore near the center of the ball striking side of the club head and extending through the club head, and wherein a portion of the energy absorbing section of the face insert is received in the bore.

* * * * *